US006510566B2

(12) United States Patent
Bryce

(10) Patent No.: US 6,510,566 B2
(45) Date of Patent: Jan. 28, 2003

(54) SHOWER CURTAIN CLOSURE

(76) Inventor: Thomas W. Bryce, 6790 Greig Ct., Brentwood Bay, BC (CA), V8M 2G4

( * ) Notice: Subject to any disclaimer, the term of this patent is extended or adjusted under 35 U.S.C. 154(b) by 0 days.

(21) Appl. No.: 09/829,963

(22) Filed: Apr. 11, 2001

(65) Prior Publication Data

US 2001/0039677 A1 Nov. 15, 2001

(51) Int. Cl.[7] ..... A47K 3/38; A47H 23/00
(52) U.S. Cl. ..... 4/609; 4/608; 160/349.1
(58) Field of Search ..... 4/609, 610, 608, 4/607, 580; 160/349.1

(56) References Cited

U.S. PATENT DOCUMENTS

| | | | | |
|---|---|---|---|---|
| 2,049,061 A | * | 7/1936 | Hoegger, Sr. | 4/609 X |
| 3,205,547 A | | 9/1965 | Riekse | |
| 3,639,919 A | | 2/1972 | White | |
| 3,879,806 A | | 4/1975 | Armstrong | |
| 4,098,318 A | * | 7/1978 | Ruegsegger | D6/580 |
| 4,361,915 A | | 12/1982 | Siewert | |
| 4,759,087 A | | 7/1988 | Zeilinger | |
| 4,765,001 A | | 8/1988 | Smith | |
| 4,771,517 A | | 9/1988 | Bonanno | |
| 4,887,324 A | | 12/1989 | Cairns | |

* cited by examiner

*Primary Examiner*—Gregory Huson
*Assistant Examiner*—Kathleen J. Prunner
(74) *Attorney, Agent, or Firm*—Robert H. Barrigar

(57) ABSTRACT

A shower curtain closure for closing off a vertical side edge of the curtain against a wall of the shower stall comprises a length of extruded plastic tubing that can be cut to a preferred length, a tube support ring for suspending the tube on the curtain rod, and an elongate vertically oriented wall receptacle into which the tube matingly fits. The tube is passed through a sleeve along the side of the curtain and is suspended from the curtain support rod by a ring connected to the upper end of the tubing and passing over the shower curtain rod. The wall receptacle is made of extruded plastics material that can be cut to length and is adhesively mountable on a wall of the shower enclosure. The receptacle is provided with a channel shaped to releasably secure the shower curtain sleeve with the tube therein.

3 Claims, 9 Drawing Sheets

FIGURE 12
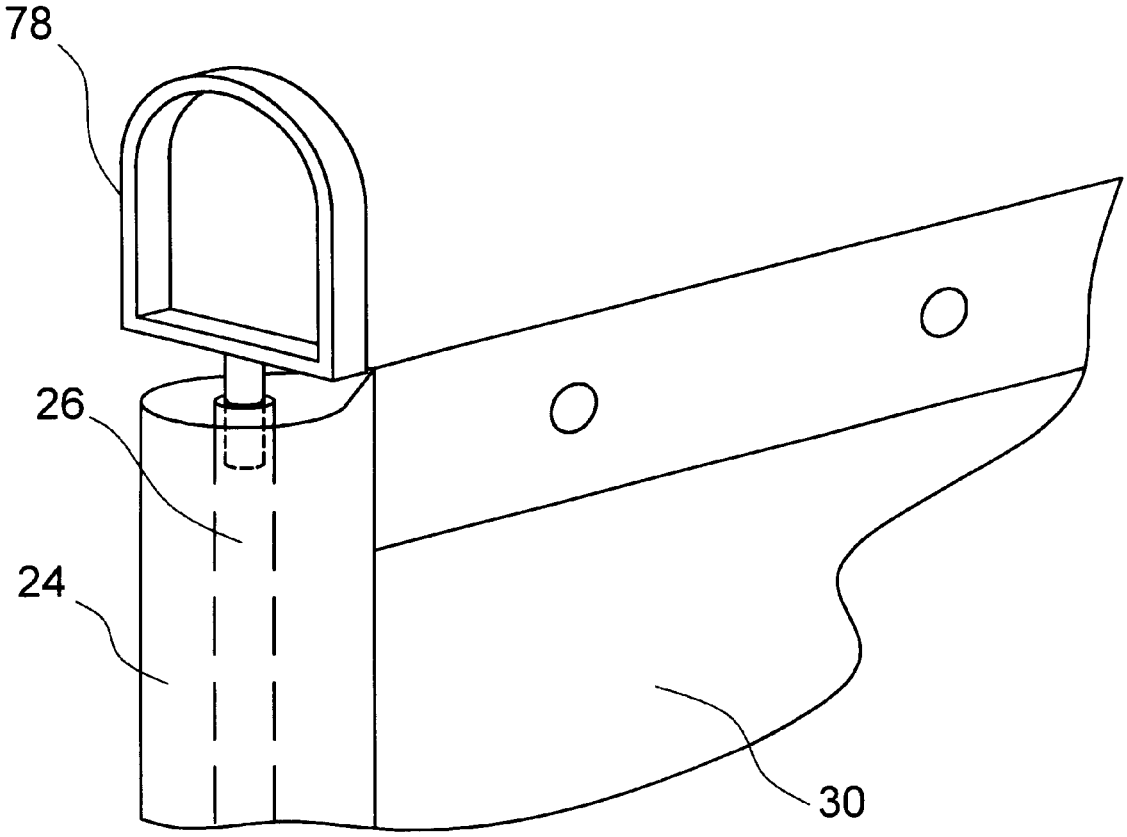
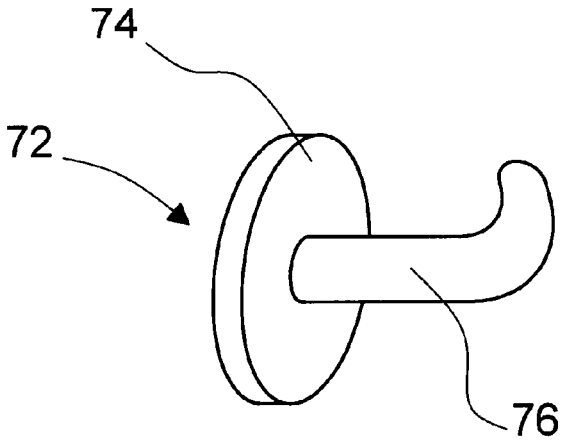
FIGURE 13

SHOWER CURTAIN CLOSURE

FIELD OF THE INVENTION

This invention relates to a shower curtain closure for closing off one or both generally vertical side edges of the curtain against a wall of a shower stall, tub enclosure or the like. Such closure is provided along one or both shower curtain edges, depending on the dimensions and other characteristics of the shower unit for which the closure is designed. In a preferred embodiment, the shower closure comprises a length of plastic tubing that can be cut to a preferred length, a tube support ring, and an elongate vertically oriented wall receptacle into which the tube matingly fits. The tube is passed through a sleeve along the side of the curtain and is suspended from the curtain support rod by the ring connected to the upper end of the tubing and passing over the shower curtain rod. The wall receptacle is adhesively mounted on a wall of the shower enclosure at the location of the intended shower curtain closure. The receptacle is shaped to releasably secure the shower curtain sleeve with the tube therein. The curtain may be slipped off the tube to permit the curtain to be laundered or replaced without having to replace the tube. The receptacle retains the shower curtain in place and impedes water from splashing between the edges of the shower curtain and the shower walls onto the bathroom floor.

BACKGROUND OF THE INVENTION

Conventionally, shower curtains hang freely from a horizontal rod or bar with no side connection to vertical walls of the shower stalls or shower/bath units. Consequently, water can easily escape between the sides of the curtain and the walls and splash outside of the shower unit, risking damage to the bathroom walls and floor and increasing the risk of injury from slipping on a wet floor surface. Various attempts have been made to solve this problem.

The majority of the prior solutions to the problem require the use of diverse strips or bars that adhere to a wall and are designed to receive a connecting component holding the shower curtain in place, therefore forming an impermeable seal. Many of the previous solutions, however, are complicated and costly or require too many changes in the design of ordinary curtains to be commercially appealing to curtain manufacturers. Such relatively complicated solutions are proposed for example in the U.S. Pat. No. 4,765,001 granted to Smith and U.S. Pat. No. 4,361,915 granted to Siewert.

White in his U.S. Pat. No. 3,639,919 designed a permanent attachment of an elongated connecting flexible rod to the edge of a shower curtain. A similar solution is disclosed in U.S. Pat. No. 4,77,517 granted to Bonanno, who also proposes a permanent attachment of a specific connecting component to the edges of the curtain. These solutions are relatively simple, but do not offer the possibility of laundering curtains by standard laundry equipment, as demanded by a large portion of the current shower-curtain market, especially by the hospitality industry. In addition, in the case of Bonanno's invention, connecting devices fastened to the outside edge of the shower curtain could possibly tear the curtain material if pulled hard or accidentally caught by a moving object.

Another previously proposed solution is to engage the curtain by a loose connecting bar that is placed into and supported by a wall attachment component having the form of a channel. This solution does not require any modification of the shower curtain. However, to combine all components of the invention into a waterproof system that best serves its purpose requires skill and patience, considering the fact that the engaging bar is not attached to the shower curtain. Examples of this type of shower curtain closure are found in U.S. Pat. No. 3,879,806 granted to Armstrong and U.S. Pat. No. 3,205,547 granted to Riekse.

The majority of the previously described solutions are not functionally designed to have adequate versatility that would enable customers or installers to easily adapt and mount the sealing system in shower areas of different heights with differently situated shower rods, and to use more or less standard curtain design with the possibility of ready removal and replacement of curtains for laundering. There is an unsatisfied demand for an inexpensive, uncomplicated and effective solution to the side closure problem, for use with ordinary shower curtains, that would offer the possibility of ready removal of the curtain for laundering or cleaning by conventional methods.

SUMMARY OF THE INVENTION

An object of the present invention is to provide a shower curtain side closure that is economical, effective and easily adaptable for manufacture and use, and can make use of shower curtains substantially as currently manufactured, or requiring at most a minor modification of the side hem or hems of the curtain.

Another object of the present invention is to provide a shower curtain side closure that is easily detachable and completely removable from the shower curtain, thereby affording the possibility of laundering or cleaning the shower curtain by conventional methods without special equipment.

Another object of the present invention is to provide a shower curtain closure that is simple to install, maintain and use in a shower stall or the like of a wide range of sizes.

In accordance with the foregoing objectives, there is provided an improved shower curtain closure for use with a shower curtain having a sleeve along at least one side of the curtain. The closure comprises an insertable tube (or equivalent) for insertion into the sleeve, and a wall-mountable receptacle having a channel for releasably securing the sleeve of the curtain with the tube inserted. For convenience and brevity of description, herein only "tube" will appear rather than a more elaborate phrase such as "tube or rod or equivalent". The term "tube" used herein, is intended to refer to a relatively stiff insertable elongate element that is not necessarily of circular cylindrical shape and not necessarily hollow. When the tube is inside the sleeve, the tube will readily engage the channel of the receptacle so that the receptacle channel flanges can grip the sleeve with the tube inserted therein, providing a relatively secure engagement, yet an engagement that the person taking the shower can readily disrupt simply by pulling on the side of the shower curtain, thereby to release the sleeve and tube from the channel of the elongate receptacle.

For purposes of reduction of manufacturing expense and reduction of weight, the tube is preferably hollow, generally cylindrical, and preferably made of plastics material; however, it could instead be a solid cylindrical dowel or rod or have polygonal cross-section. Design compromises may have to be made in the choice of tube shape, dimensions and material. Softer, more flexible materials are less likely to do any damage to the shower curtain during the step of insertion of the tube into the shower curtain sleeve. Stiffer, harder materials, however, may be somewhat easier to insert into the receptacle channel over the entire length of the channel.

While light weight is advantageous, if the tube is too flimsy, the tube may be irreversibly bent or damaged. Different choices of materials and dimensions of the tube may be made depending upon whether the shower curtain material is expected to be woven fabric on the one hand, or is expected to be sheet plastics material on the other hand.

In a preferred embodiment, the insertable tube should be resilient, inexpensive, and adequately strong to meet the repetitive securing/releasing demands of the user. Conveniently the insertable tube may be provided at one end (the upper end in use) with a hole or hook or ring connector through which a conventional shower curtain support ring may be inserted, whereby the tube may be suspended from the shower curtain support rod at one end of the shower enclosure (or closures of this type may be provided at both ends of the enclosure, if the user so wishes). In another embodiment of the invention, the insertable tube may be provided at one end (the upper end in use) with a loop whereby the tube may be suspended, e.g. from a bracket mounted on the wall of the shower enclosure.

The receptacle is preferably an elongate double-flanged element made of suitable resilient material whose planar base portion may be attached to the shower enclosure wall, preferably adhesively, so that the receptacle extends generally vertically in about the plane of the hanging shower curtain. Each of the side edges of the receptacle is bent inwardly thereby forming a pair of opposed gripping flanges that with the base form a securing channel for receiving the rod or tube inside the sleeve. The space between the gripping flanges at the distal edges thereof should be somewhat less than the diameter of the insertable tube (or at least less than the combined thickness of the tube inserted within the sleeve of the shower curtain). The distance between the flanges at their line of juncture with the base is greater than that combined thickness. The flanges extend outwardly from the base sufficiently that their distal edges lie more than halfway across the tube in the curtain sleeve when the tube and sleeve have been fully inserted into the receptacle, thereby securing the curtain hem in place within the receptacle. Advantageously the underside of the base of the receptacle (that side opposite the side on which the flanges lie) may be provided with an adhesive layer coating covered by a strip of release paper for ease of mounting the receptacle on the shower enclosure wall.

The receptacle may alternatively comprise a plurality of discrete claw-like gripping elements installable as a vertically spaced series. Each discrete gripping element may have a base and inwardly bent side edges forming a securing channel for receiving a portion of the rod or tube inside the sleeve. While the gripping elements may be individually attached to the wall, conveniently the gripping elements may be mounted on a strip base for structural integrity, ease of manufacture, ease of adhesive mounting, and controlled spacing.

Both the insertable tube and the receptacle may be cut from extruded plastics stock material of the preferred cross-section and sold in oversize lengths, permitting the purchaser to cut the receptacle to fit the enclosure wall and the rod or tube to fit the particular shower curtain for which it is intended. Both the tubing material and the receptacle material can be manufactured in unlimited lengths that can be cut first of all to meet standard packages for sale to the consumer, and second of all, cut to length by the consumer for use in any discrete location. The distance between the bathtub ledge or shower stall sill and the top of the curtain as it hangs from the shower curtain suspension rod are quite variable from situation to situation. It follows that the ability of the customer to cut the receptacle and the tubing to length is of significant advantage, while from a manufacturing standpoint, a low cost of production is achieved by using extruded stock for both receptacle and tubing.

Since fabric shower curtains may normally be provided with side hems as a matter of routine manufacture, it is easy for such curtains to be manufactured so that at least one side includes a sleeve large enough to accommodate an insertable tube of a convenient cross-section. The fit of the sleeve over the tube (whether the shower curtain is made of fabric or sheet plastics material) should be loose enough to permit easy insertion, but not so loose as to interfere with ease of insertion of the sleeve with tube inside into the receptacle. The curtain should also be readily capable of removal from the tube so that it can be laundered or cleaned. Conveniently the sleeve is formed in both sides of the curtain so that the curtain may be hung in either orientation to accommodate an enclosure whose shower nozzle is at either end of the enclosure. Closures may be provided along both walls bordering on the shower enclosure opening if desired.

The sleeve may be formed on the side of the curtain either by sewing, if a fabric curtain is to accommodate the closure device of the present invention, or by a suitable heat-seal method if a suitable plastics material such as vinyl is to be used. Neither one of these two methods obliges shower curtain manufacturers to install new manufacturing equipment in order to accommodate the present invention.

The closure of the invention facilitates a simple one-step action to secure or disengage the shower curtain side edge to or from the adjacent wall(s) without any special effort and without fear of tearing the shower curtain. After inserting the resilient tube into the wall receptacle, the closure blocks the water from splashing outside of the shower unit and thus protects the bathroom floor and objects near the shower from accidental wetting.

Note that in the preferred installation, the curtain does not bear the weight of the plastic tube and can be easily disengaged from the tube, facilitating cleaning or laundering of the curtain using conventional cleaning or laundry equipment. These attributes of the invention coupled with the ease of cut-to-length manufacture and installation by the end user are important to manufacturers, installers and final users, contributing both to low cost of manufacture, convenience of installation, and convenience of use.

BRIEF DESCRIPTION OF THE DRAWINGS

FIG. 12 is a schematic detail perspective view of a portion of the embodiment of FIG. 1, illustrating an embodiment of the tube-suspension means for suspending the plastic tubing from the hook on the wall, according to the present invention.

FIG. 13 is a perspective view of a portion of the embodiment of FIG. 1, illustrating an embodiment of the wall connector for suspending the plastic tubing from the wall, according to the present invention.

DETAILED DESCRIPTION OF THE INVENTION

Figure 1:
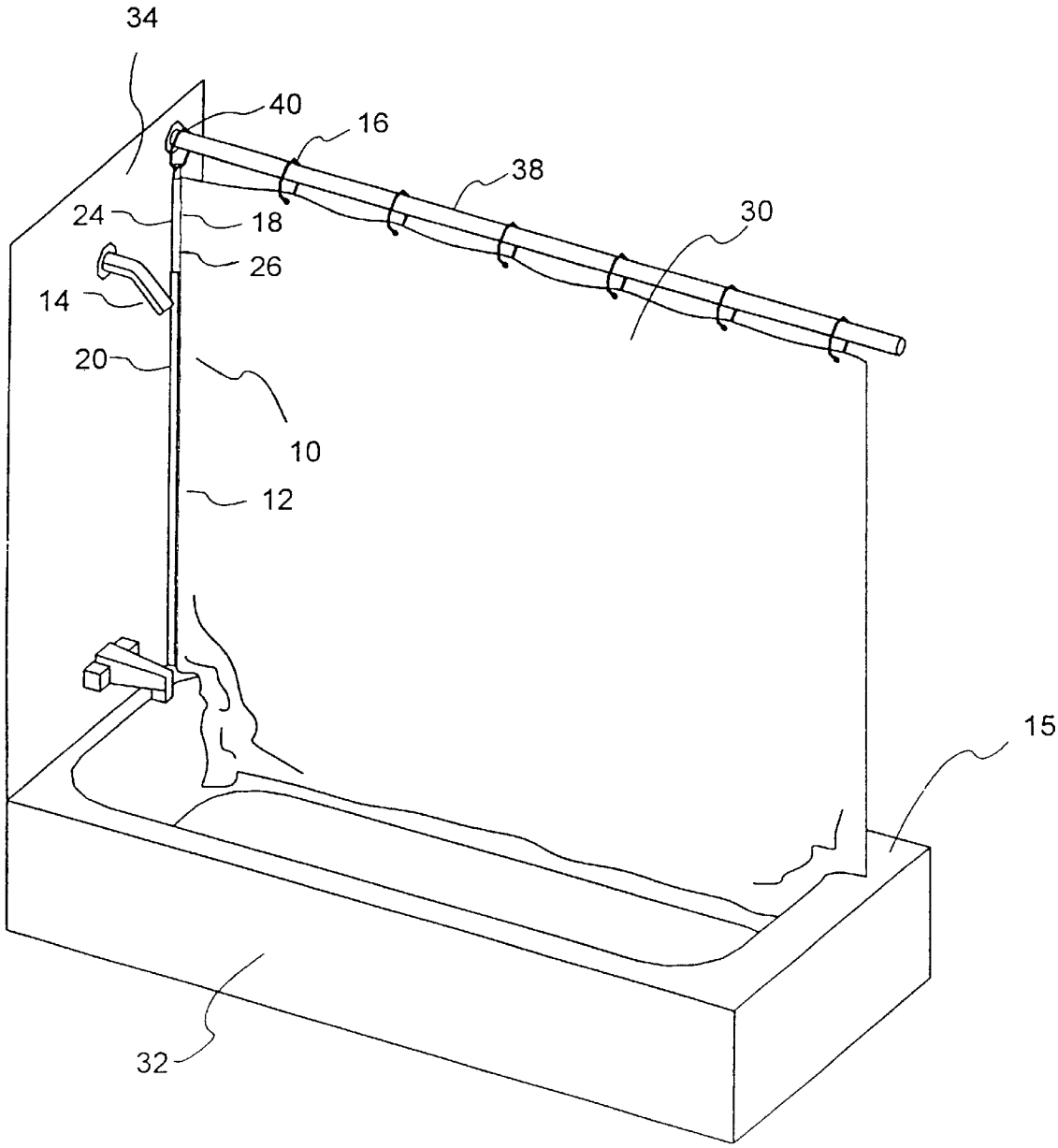
FIG. 1 is a schematic perspective view of a tub/shower unit with an installed shower curtain closure according to a preferred embodiment of the present invention.

Referring now to the drawings, there is shown in FIG. 1 part of a conventional tub/shower enclosure 32; in the interest of graphic clarity, the back wall of the enclosure 32 has been removed; it would be the closest wall to the viewer. The right side wall (as seen by the viewer) is not present; it might or might not be present in an actual enclosure 32, depending on the particular installation of the tub/shower enclosure 32 in a bathroom. On the left side wall 34 (as seen by the viewer), a conventional shower nozzle 14 is mounted. A conventional shower curtain 30 is suspended on a shower curtain support rod 38 by means of conventional shower curtain support rings 16.

Figure 2:
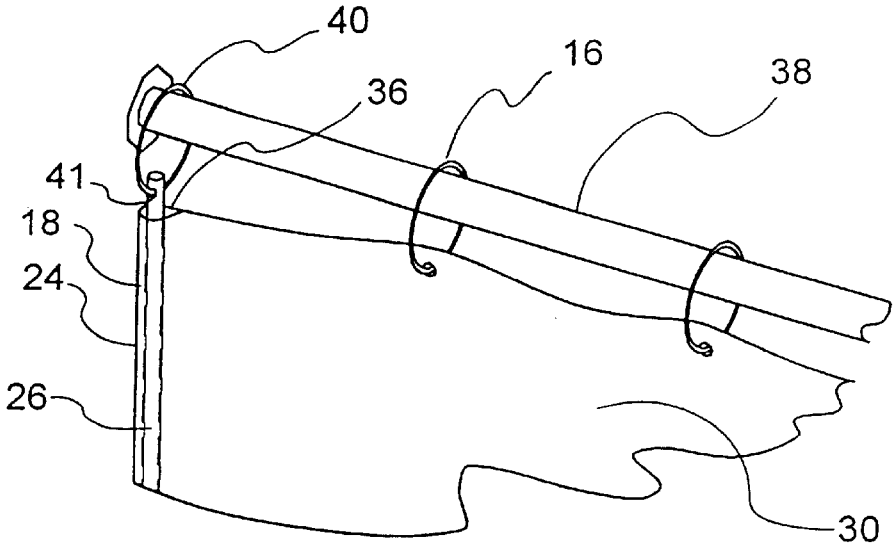
FIG. 2 is a schematic fragmentary detail perspective view of a portion of FIG. 1, illustrating an embodiment of the tube-suspension means for suspending the plastic tubing on the shower curtain rod, according to the present invention.
Figure 7:
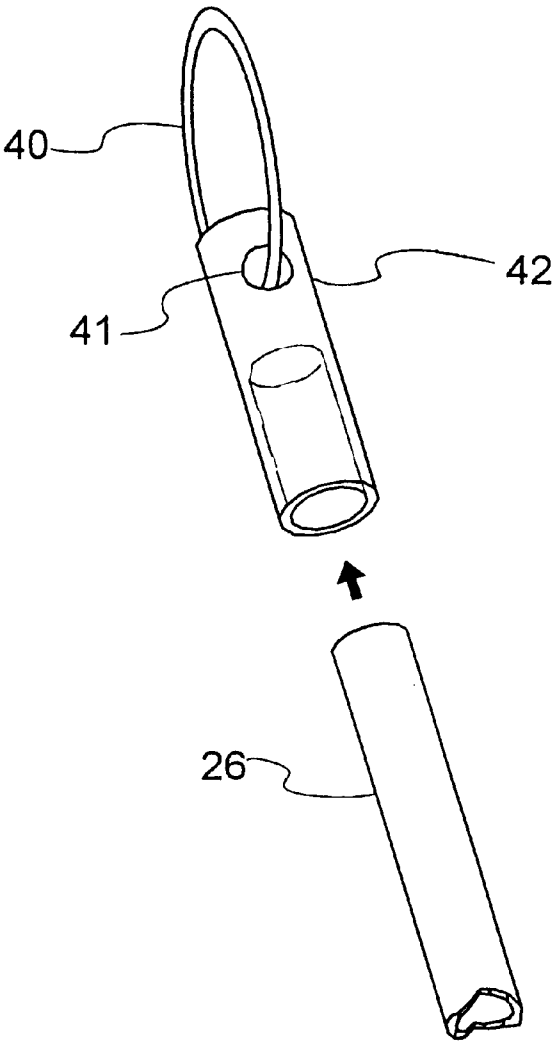
FIG. 7 is a detail schematic fragment perspective view showing an alternative embodiment of a suspension means for the plastic tube of FIG. 1 including a coupling and a ring that will pass over the shower curtain support rod.

A shower curtain closure generally indicated by reference numeral 10 has been installed in the bath/shower unit 32. The closure 10 is intended to impede splashing of water out of the enclosure 32 between the side edge 12 of the curtain 30 and the adjacent wall 34. The closure 10 comprises at a minimum of two components, viz a length of plastics tubing 26 (see also FIGS. 2, 6, 7) that has been cut to a preferred length, and an elongate vertically oriented wall-mounted receptacle 20 (see also FIGS. 3, 4, 5) into which the tube 26 matingly, securingly and releasably fits. The tube 26 is passed through a sleeve 24 (see also FIGS. 2, 4, 5) along the side 18 of the curtain 30; the sleeve 24 provides a vertically elongate opening 36 (FIG. 2) through which the tube 26 passes.

If the tube 26 is light enough and the frictional force between the tube 26 and the curtain sleeve 24 strong enough, the tube 26 need not be provided with any independent suspension means but may be retained within the sleeve 24 by the force of friction. However, since an object of the invention is to have the tube 26 easily insertable within the sleeve 24 and to have the curtain 30 readily removable from the tube 26 for cleaning or laundering, and as the force of friction can sometimes be reduced if soap and water find their way between the sleeve 24 and the tube 26, the sleeve 24 is preferably appreciably larger than the tube 26, not so much larger as to interfere with the gripping of the sleeve 24 with tube 26 inserted therein by the receptacle 20, but large enough to permit ready insertion of the tube 26 into the sleeve 24 without inordinate resistance, and to permit ready removal of the curtain 30 from the tube 26 by pulling the sleeve 24 downward relative to the tube 26. In a preferred embodiment, the tube has a diameter of about ½", in which case the perimeter of the sleeve 24 should be approximately 2 ½" to permit easy insertion of the tube 26 into the sleeve 24 and easy disengagement of the tube 26 from the sleeve 24.

Figure 9:
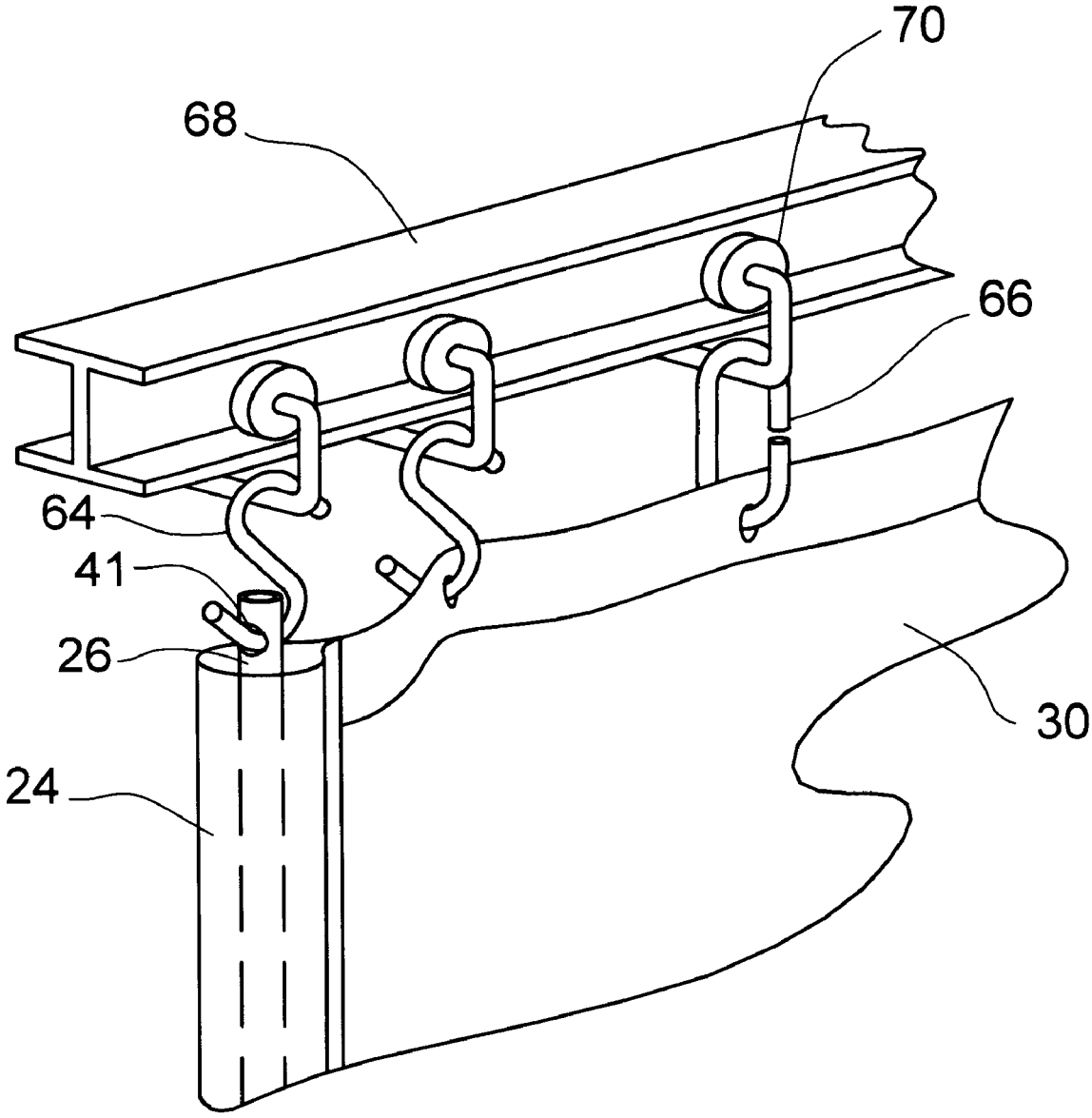
FIG. 9 is a schematic fragmentary detail isometric view, illustrating an embodiment of the tube-suspension means for suspending the plastic tubing from a beam, according to the present invention.
Figure 10:
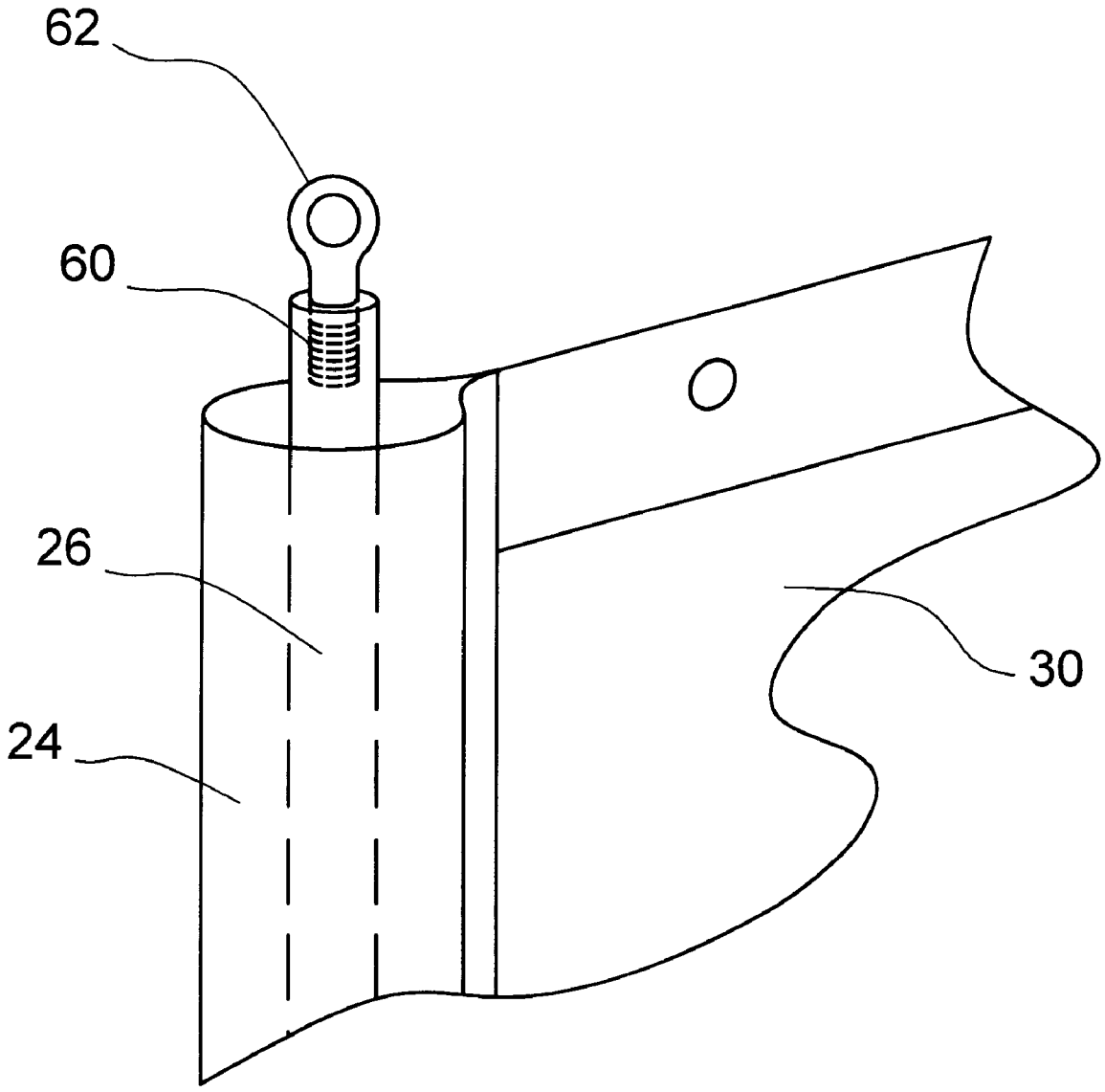
FIG. 10 is a detail schematic fragment perspective view showing an alternative embodiment of a suspension means for the plastic tube of FIG. 1 including a plug and an eye.

Accordingly, in a preferred embodiment of the closure 10, the tube 26 is suspended from the curtain support rod 38 by a tube support ring 40 (see also FIG. 2) passing through apertures 41 (FIG. 6) in the upper end of the tube 26 and passing over the shower curtain support rod 38. Conveniently, the ring 40 may be a conventional shower curtain support ring identical to each of the rings 16. This suspension means is one of the simplest and least expensive suspension means available for supporting the tube 26. Alternatively, the upper end of the tube 26 may be tightly gripped by a hollow cylindrical coupling 42 (FIG. 7) whose lower end has an inner diameter less than the outer diameter of the tube 26, thereby providing a crimp fit of the tube 26 into the coupling 42, and whose upper end is provided with apertures 41 to receive the support ring 40. In the further alternative, the upper end of the tube 26 may be matingly engaged with a plug 60/eye 62 combination (FIG. 10), wherein the plug 60 is sized and shaped to fit snugly within the tube 26 and the eye 62 is sized and shaped to receive the support ring 40 or other device for suspending the tube 26. Alternatively, the tube support ring 40 may be a conventional shower curtain support ring or hook passing through the apertures 41; or alternatively, passing through holes or eyes at the upper end of the cylindrical coupling 42 or plug 60, or passing through a ring or hook which is passing through the apertures 41. Other means of support of the tube 26 may readily be devised, such as a metal wire S-hook 64 or a conventional metal wire curtain hook 66 (FIG. 9). As shown in FIG. 9, S-hooks 64 and metal wire curtain hooks 66 are often used to suspend shower curtains from mini I-beam track 68/slider 70 combinations, commonly seen in travel trailers and pleasure boats.

Figure 11:
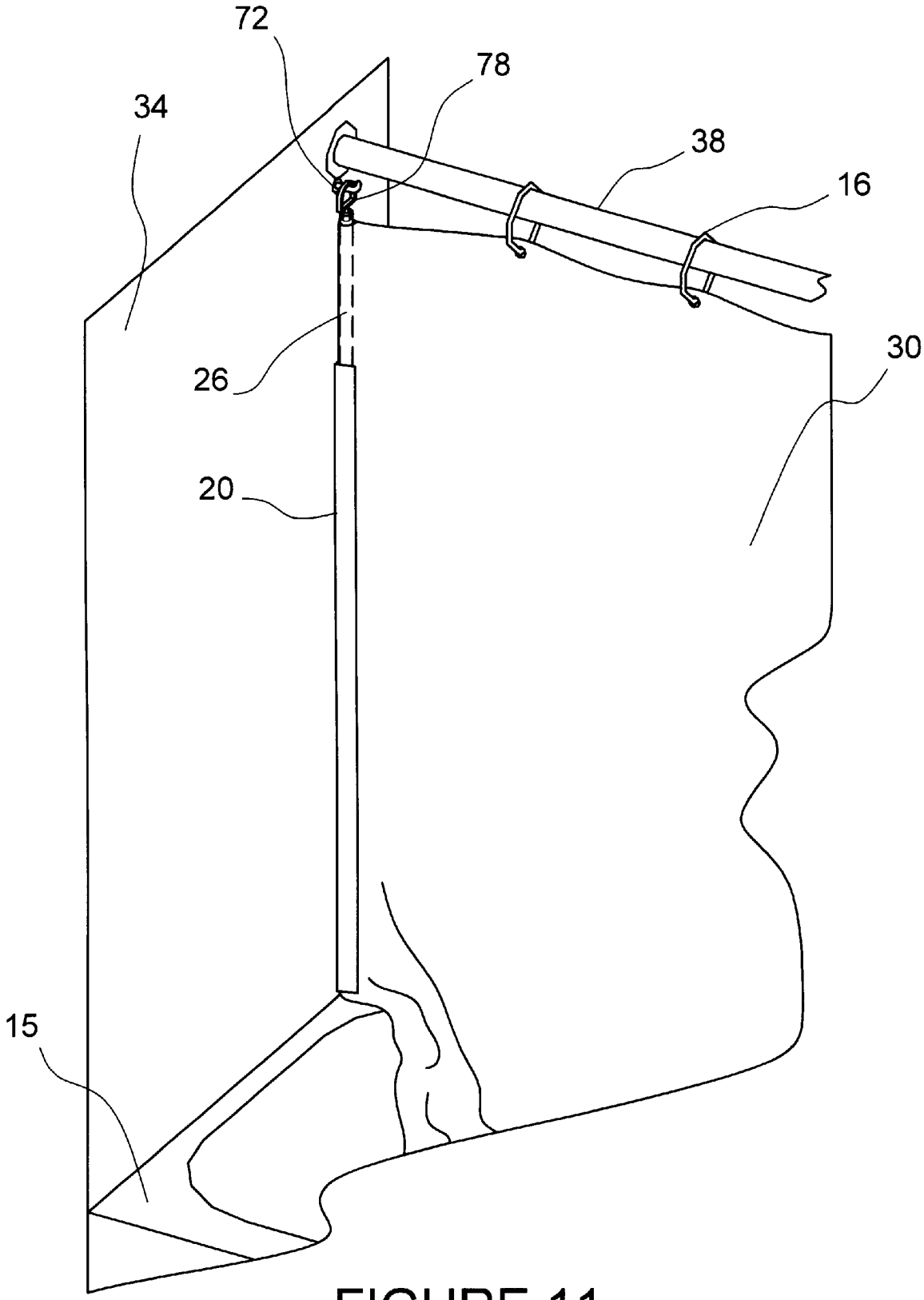
FIG. 11 is a schematic perspective view of a tub/shower unit with an installed shower curtain closure including a bracket for suspending the plastic tubing from the wall, according to an embodiment of the present invention.

The tube 26 is conveniently suspended on the shower curtain rod 38, but might instead be suspended on a bracket (FIGS. 11 and 13) attached to the adjacent enclosure wall 34. As shown in FIG. 13, in one embodiment, the bracket 72 consists of a bracket base 74 and a projecting bracket hook 76. The underside (not shown) of the bracket base 74 is preferably provided with an adhesive layer or coating covered by a release strip (not illustrated); such layers and coatings are conventional for adhesively mounting similar devices onto walls. Alternatively, a double-sided adhesive layer having release strips on both sides can be provided to mount the bracket 72. Alternatively, fasteners such as screws (not shown) can be used to mount the bracket 72. As shown in FIG. 12, in this embodiment, the upper end of the tube 26 is coupled to a loop 78 sized and shaped for slipping over the bracket hook 76. The bracket hook 76 may include a means (not shown) for securing the loop 78, such as an arm pivotally attached to the bracket base and configured to pivot to, and lock in, a closed position across the opening between the end of the bracket hook 76 and the bracket base 74. Suspending the tube 26 on a bracket hook 76 may be advantageous in situations where one end of the shower curtain 30 is rarely opened and it is desirable to prevent the tube 26 and sleeve 24 from being inadvertently pulled from the receptacle 20 when the shower curtain 30 is drawn to close the other end of the shower enclosure 32 opening.

Other means of supporting shower curtains 30 are well known. It will be clear to those skilled in the design of shower stalls and curtains that the closure 10 can work equally well with means of shower curtain support other than a shower curtain support rod 38 and shower curtain support rings 16.

Depending upon the distance between the sleeve 24 and the suspension ring 16 nearest the closure 10, the tube 26 may have a greater or lesser tendency to bind within the sleeve 24. In some cases, especially if the tube 26 is very light weight and if the sleeve is only marginally larger in available diameter than the tube diameter, and also depending upon the choice of materials of which the tube 26 and curtain 30 are made, the binding may be sufficient that the tube 26 is fully supported entirely by the curtain 30 itself rather than by the support ring 40. However, it is desirable to include upper suspension of the tube 26 in most cases, since over time the frictional force between the tube 26 and the sleeve 24 may be expected to vary considerably. Note also that because the degree of binding may vary, manufacturers of both shower curtains and rods may wish empirically to select a preferred location of the eye of the shower curtain that receives such nearest suspension ring 16, so as to minimize binding. Binding is generally undesirable as it impedes the user's ability to quickly insert the tube into the sleeve or to remove the tube from the sleeve.

The underside of the receptacle 20 is preferably provided with an adhesive layer or coating covered by a release strip 22; such layers and coatings are conventional for adhesively mounting such receptacles or other similar devices onto walls. Alternatively, the receptacle 20 could be a conventional integral piece of extruded plastics material and separately a double-sided adhesive layer having release strips on both sides could be provided. Removal of the release strip or strips enables the underside 20 to be adhesively mounted on the adjacent wall 34 of the shower enclosure 32 at the location of the intended shower curtain closure. If adhesive attachment of the receptacle 20 to the wall 34 is considered too insecure, mounting screws or the like (not shown) could supplement the adhesive mounting. As sold to the consumer, the receptacle 20 may be of one or more standard lengths, or may be sold oversize, in which latter case the consumer would cut the receptacle 20 to the preferred length. Note that as the curtain 30 may have folds near the bottom of the receptacle 20 when the receptacle 20 is mounted on the wall 34, it may be desirable to leave a small space between the bottom edge of the receptacle 20 and the top surface 15 of the tub so that the folds of the curtain 30 do not interfere with the gripping by the receptacle 20 of the side edge 12 of the curtain 30 with tube 26 inserted in the sleeve 24.

Since the distance between the lower edge of the shower enclosure opening (the top tub wall 15 as seen in FIG. 1) and the shower curtain rod 38 tends to be quite variable, the tube 26 is preferably sold oversize and cut to length by the consumer. Conventional extruded vinyl tubing is inexpensive and easily cut, yet strong and durable enough to survive repeated engagement, disengagement, pulling, etc. As mentioned above, a plastics or wooden rod or the like could be substituted for the tube 26, but a useful insertable tube or rod should preferably be of a diameter that is easily handled and provides an adequate securing engagement with the mating receptacle 20; this tends to suggest the use of tubing of at least about ¼" in diameter and preferably closer to ½"; tubes of ½" diameter have been found to be quite suitable. Since a rod of such diameter would typically be heavier and more expensive than suitable tubing, tubing is preferred. The channel material and the tubing can be provided in different lengths for use in a shower stall on the one hand, or a tub/shower enclosure on the other hand. In the latter case, both the channel and the tubing supplied could be shorter in length than for a full-height shower stall. (It would be uneconomical to provide the longest usable lengths of tubing and channeling needed for a full-height shower stall if the user plans to use the closure for a standard bathtub/shower enclosure.) Accordingly, channel material and tubing of various lengths can be distributed and sold in different packages for different types of shower units.

Figure 4:
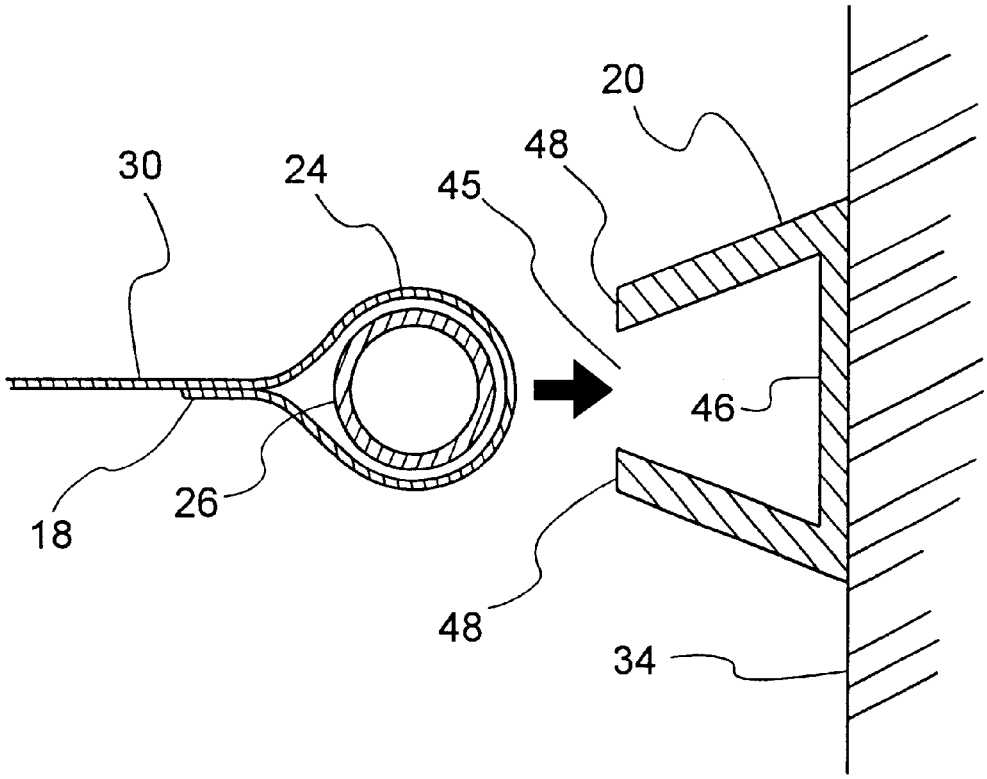
FIG. 4 is a schematic enlarged section view of a closure according to FIG. 1, illustrating the plastic tube inserted into a sleeve along the side of the curtain when the plastic tube is about to engage the wall-mounted receptacle.
Figure 5:
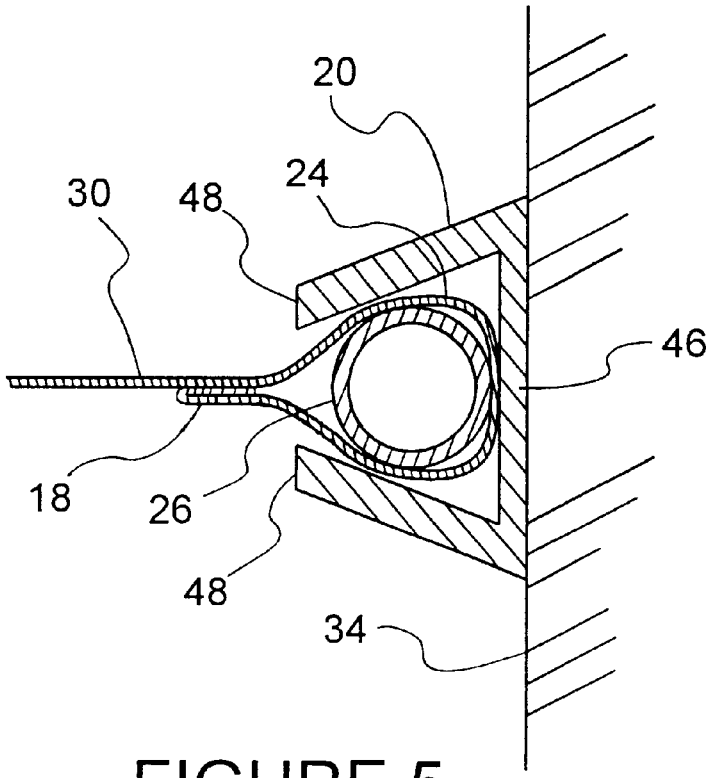
FIG. 5 is a schematic enlarged section view of a closure according to FIG. 1, showing the plastic tube inserted within the sleeve along the side of the curtain, and the combined sleeve and tube matingly and securingly releasably engaged by the wall-mounted receptacle.
Figure 6:
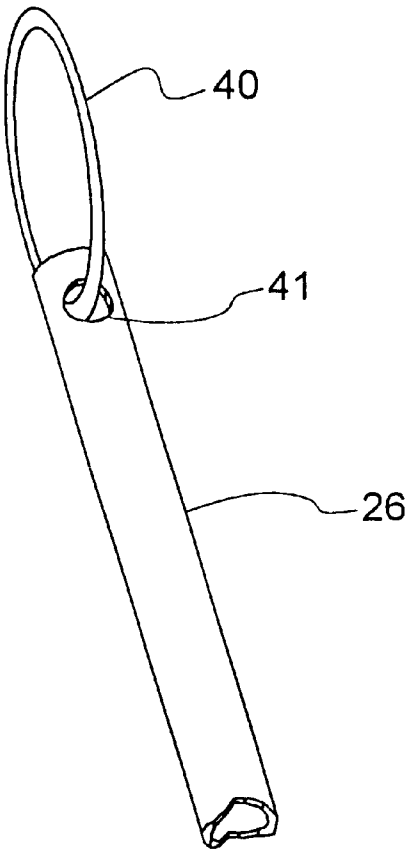
FIG. 6 is a schematic fragment detail perspective view illustrating one embodiment of a suspension means for the plastic tube of FIG. 1 including a ring that will pass over the shower curtain support rod.

FIGS. 4 and 5 illustrate in more detail the engagement of the sleeve 24 and tube 26 with the receptacle 20. As indicated by the arrow in FIG. 4, the sleeve 24 and tube 26 are moved laterally (that is, substantially horizontally in conventional installations where the receptacle 20 is mounted on a vertical surface) to engage the sleeve 24 and tube 26 with the receptacle 20, and to disengage the sleeve 24 and tube 26 from the receptacle 20. It can be seen that the outer diameter of the combined sleeve 24 and tube 26 slightly exceeds the width of the gap 45 between opposed inwardly-bent side flanges 48 integral with base 46 of the receptacle 20. Accordingly, the side flanges 48 resiliently give way and permit the gap 45 to widen when the sleeve 24 and tube 26 are pushed into the gap 45. Alternatively, the tube 26 resiliently deforms when the sleeve 24 and tube are pushed into the gap 45. A further alternative is for both to occur, that is for the tube 26 to resiliently deform and the side flanges 48 to resiliently give way when the sleeve 24 and tube 26 are pushed into the gap 45. Since the inside width of the base 46 is appreciably greater than the outer diameter of the combined sleeve 24 and tube 26, and since the flanges 48 project outwardly sufficiently to permit the combined sleeve 24 and tube 26 to pass completely through the gap 45, the gap 45 closes to its rest width once the combined sleeve 24 and tube 26 have been completely inserted into the receptacle 20. The arrangement just described is preferred, but the closure is workable, albeit not optimally usable, if the distance between the distal ends of the flanges 48 and the base 46 is appreciably more than half the outer diameter of the combined sleeve 24 and tube 26. Obviously the selection of the material of the receptacle 20, its thickness, and the dimensions of the base 46 and flanges 48 should be selected so that the resilience of the flanges relative to the base 46 permits ready insertion and removal of the combined sleeve 24 and tube 26 into and out of engagement with the receptacle 20, while being sufficiently strong and stiff to secure the combined sleeve 24 and tube 26 in place within the receptacle 20 during normal use. Suitable extruded material conforming generally in shape to the cross-section of receptacle 20 as illustrated in FIG. 4 is readily available.

FIGS. 4 and 5 respectively illustrate alternative sleeve formation arrangements in the side of the curtain 30. In FIG. 4, the curtain material is assumed to be a plastics sheet (e.g. vinyl), in which case the sleeve 24 is formed by heat-sealing the side 18 of the sheet to an inset portion of the material; the inset is chosen to be sufficient to produce a sleeve 24 that comfortably surrounds the tube 26 but does not generate undue interference with the tube 26 when the latter is inserted or disengaged (always assuming suspension support for the tube 26; the alternative friction support of the tube 26 within the sleeve 24 would require a tighter fit of the tube 26 within the sleeve 24). In FIG. 5, the curtain material is assumed to be made of a woven fabric, in which case there would typically be a hem provided to avoid an open raw edge of the material. It can be seen from this view that the side edge 18 is given a small fold, and the resulting hem is stitched to an inset portion of the curtain to provide a sleeve 24 as before. The stitching is not visible in FIG. 5 but would extend vertically along the hem, attaching the hem to the curtain material at or just beyond the limit of the sleeve 24.

After securing the combined sleeve 24 and tube 26 into the wall-mounted receptacle 20, the closure 10 forms a reasonably tight obstacle that blocks water from splashing outside of the shower enclosure 32. A trade-off has to be made between ease of insertion of the lower part of the combined sleeve 24 and tube 26 into the wall-mounted receptacle 20, on the one hand, and maximum blockage of water, on the other hand. If the curtain material is not too bulky, the receptacle 20 can extend to or almost to the upper surface of the tub 15 (or to the upper edge of the sill of some other types of shower enclosures). It has been found that if the bottom of the tube 26 is permitted to rest on the upper surface of the tub ledge or sill, the risk of water splashing out of the shower enclosure in the vicinity of the bottom of the tube 26 is minimized. This suggests that a relaxed attachment of the tube 26 to the curtain rod 38 by the ring 40 is optimum, permitting the tube 26 to reach such ledge or sill upper surface. This is enabled by cutting or selecting the tube length so that the tube 26 is slightly longer than the distance between the ledge or sill and the top of the shower curtain, so that the tube 26 tends to rest (apart from a possible underlying layer of shower curtain material) on the bathtub ledge or shower stall sill or the like. Accordingly, the tube 26 is slightly overlength so that its weight is borne primarily by the ledge or sill rather than by the curtain rod 38. This relaxed attachment also facilitates upward and downward shifting of the tube 26 for optimal engagement with the channel of the receptacle 20. Note that there is sufficient slippage of the ring 40 relative to the curtain rod 38 to permit such relaxed attachment.

Figure 3:
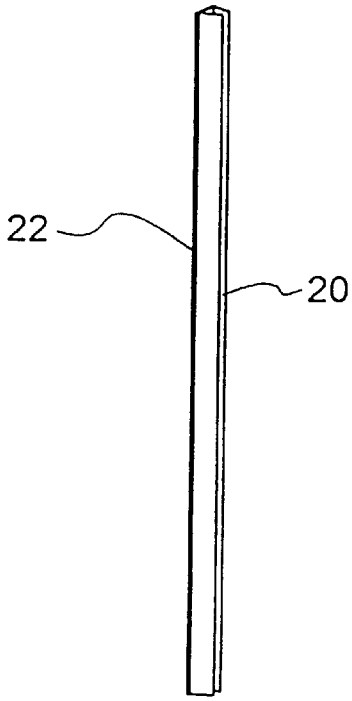
FIG. 3 is an isometric view of the receptacle of FIG. 1.
Figure 8:
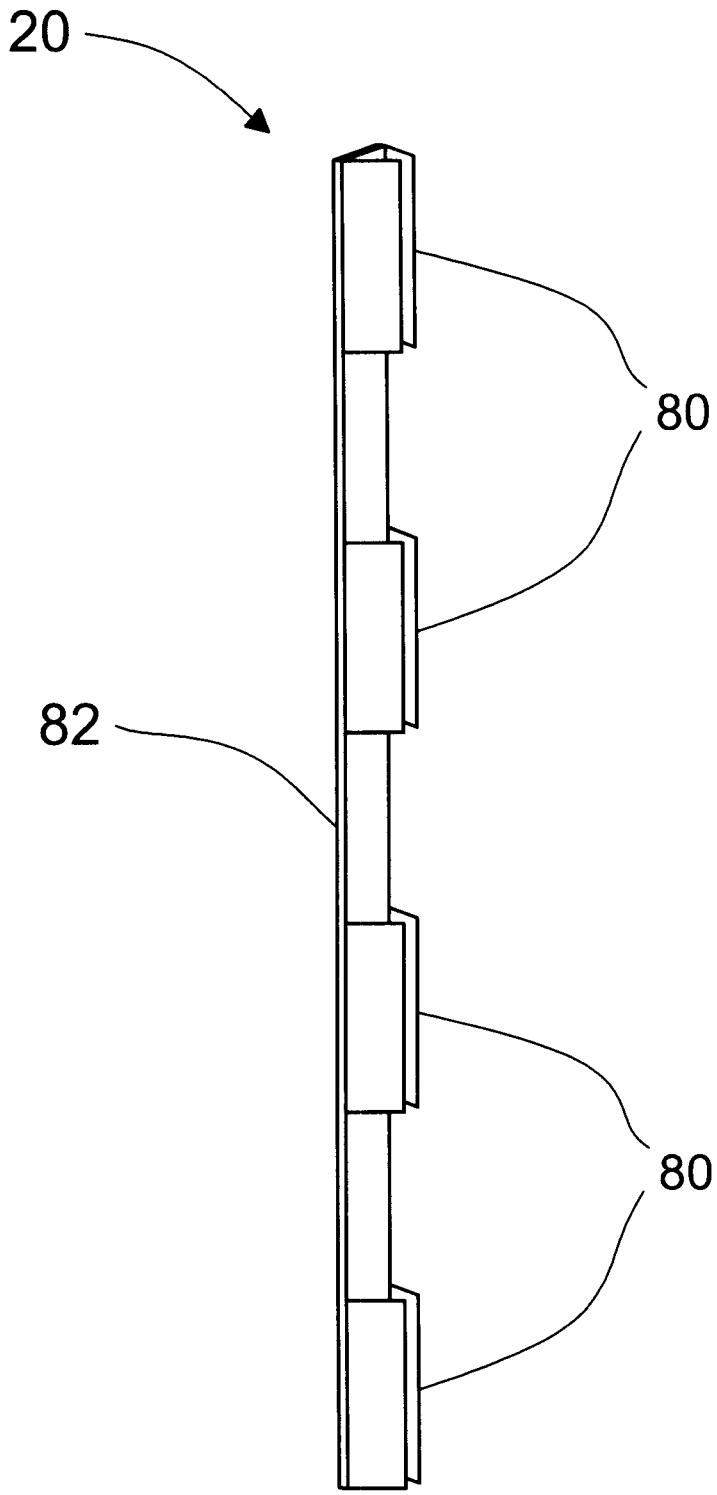
FIG. 8 is an isometric view of an embodiment of the receptacle.

The receptacle 20 is preferably formed as a continuous elongate channel as described (FIG. 3). But a series of vertically-spaced tube-gripping elements 80 could be substituted, possibly each individually mounted, although preferably mounted on a strip base 82 for structural integrity, ease of manufacture, ease of adhesive mounting, and controlled spacing (FIG. 8). In other words, the channel of the receptacle 20 need not be continuous, but can be interrupted. The essential aspect is that there be enough of a gripping security over the length of the channel that the tube 26 and curtain sleeve 24 are held reasonably securely in place throughout the length of the shower closure 10. This, however, does not necessitate that the channel be absolutely continuous. Substitute vertically-spaced tube-gripping elements might, for example, have an arcuate cross section instead of an angular cross section as in the preferred embodiment illustrated.

Other variants and modifications within the ambit of the invention will readily occur to those skilled in the design of shower stalls and curtains. The scope of the invention is as defined in the accompanying claims. In the claims, "tube", according to the prior definition in the specification, refers to a relatively stiff insertable elongate element; "ledge" includes sill or equivalent; and "shower curtain support rod" includes the various rods, tracks, channels, beams and other devices for supporting a shower curtain.

What is claimed is:

1. A shower curtain closure adapted to be used with a shower curtain suspendable from a shower curtain support rod in a shower enclosure having a generally horizontal ledge and a generally vertical wall in the vicinity of the entry to the enclosure, the curtain having a sleeve along a side thereof;

the shower curtain closure comprising in combination:

(a) an elongate insertable element of selected strong, light, resilient material, the insertable element adapted for removable insertion into the sleeve, and the insertable element being adapted to be overlength relative to a selected portion of the sleeve corresponding to an expected portion thereof lying between the top of the curtain when mounted and the ledge, said overlength insertable element adapted for cutting to preferred length by the user; and (b) an elongate receptacle adapted for mounting on the wall and for mating engagement and releasable securing therein of the insertable element inserted in the sleeve of the curtain when the receptacle and curtain have been installed, wherein the insertable element and sleeve may be moved laterally into engagement with the receptacle, thereby to secure the side of the curtain against the wall, and the insertable element and the sleeve may be moved laterally to disengage from the receptacle, thereby to release the curtain from the wall; and (c) means for suspending the insertable element from the shower curtain support rod, wherein the means for suspending the insertable element from the shower curtain support rod includes an aperture through the insertable element in the vicinity of the upper end of the insertable element when installed.

2. A shower curtain closure adapted to be used with a shower curtain suspendable from a shower curtain support rod in a shower enclosure having a generally horizontal ledge and a generally vertical wall in the vicinity of the entry to the enclosure, the curtain having a sleeve along a side thereof;

the shower curtain closure comprising in combination:

(a) an elongate insertable element of selected strong, light, resilient material, the insertable element adapted for removable insertion into the sleeve, and the insertable element being adapted to be overlength relative to a selected portion of the sleeve corresponding to an expected portion thereof lying between the top of the curtain when mounted and the ledge, said overlength insertable element adapted for cutting to preferred length by the user; and (b) an elongate receptacle adapted for mounting on the wall and for mating engagement and releasable securing therein of the insertable element inserted in the sleeve of the curtain when the receptacle and curtain have been installed, wherein the insertable element and sleeve may be moved laterally into engagement with the receptacle, thereby to secure the side of the curtain against the wall, and the insertable element and the sleeve may be moved laterally to disengage from the receptacle, thereby to release the curtain from the wall; and (c) means for suspending the insertable element from the shower curtain support rod, wherein the insertable element has an opening at the upper end of the insertable element when installed and wherein the means for suspending the insertable element from the shower curtain support rod includes a plug connected to an eye, the plug sized and shaped to fit snugly within the opening.

3. A shower curtain closure adapted to be used with a shower curtain suspendable from a shower curtain support rod in a shower enclosure having a generally horizontal ledge and a generally vertical wall in the vicinity of the entry to the enclosure, the curtain having a sleeve along a side thereof;

the shower curtain closure comprising in combination:

(a) an elongate insertable element of selected strong, light, resilient material, the insertable element adapted for removable insertion into the sleeve, and the insertable element being adapted to be overlength relative to a selected portion of the sleeve corresponding to an expected portion thereof lying between the top of the curtain when mounted and the ledge, said overlength insertable element adapted for cutting to preferred length by the user;

(b) an elongate receptacle adapted for mounting on the wall and for mating engagement and releasable securing therein of the insertable element inserted in the sleeve of the curtain when the receptacle and curtain have been installed, wherein the insertable element and sleeve may be moved laterally into engagement with the receptacle, thereby to secure the side of the curtain against the wall, and the insertable element and the sleeve may be moved laterally to disengage from the receptacle, thereby to release the curtain from the wall; and (c) means for suspending the insertable element from the wall, wherein the means for suspending the insertable element from the wall includes a bracket mountable on the wall and having a projecting bracket hook.

* * * * *